US005181621A

United States Patent [19]

Plaehn

[11] Patent Number: 5,181,621

[45] Date of Patent: Jan. 26, 1993

[54] TUB-SHOWER HEADER-BAR ACCESSORY-RACK W/UNIVERSAL-BRACKET

[76] Inventor: Jay L. Plaehn, 1765 (#68) Garnett Ave., San Diego, Calif. 92109

[21] Appl. No.: 700,585

[22] Filed: May 15, 1991

[51] Int. Cl.[5] ..... A47F 5/14

[52] U.S. Cl. ..... 211/181; 211/126; 211/88; 248/309.1; 248/311.2; 248/231.8

[58] Field of Search ..... 248/309.1, 302, 311.2, 248/153, 175, 214, 231.5, 231.6, 231.8; 211/88, 126, 181; D6/525, 524, 506, 403; 47/66, 68, 39, 81

[56] References Cited

U.S. PATENT DOCUMENTS

| | | | |
|---|---|---|---|
| D. 288,998 | 3/1987 | Wiggins | D6/524 |
| 2,647,716 | 8/1953 | Hudziak et al. | 248/231.8 |
| 2,865,588 | 12/1958 | McCartney | 248/231.8 |
| 3,194,526 | 7/1965 | Lemmond | 248/231.8 X |
| 3,789,996 | 2/1974 | Stroh | 248/302 |
| 3,923,162 | 12/1975 | Hussey | 248/302 |
| 4,372,449 | 2/1983 | Fink | 248/214 |
| 4,492,499 | 1/1985 | Gasper | 410/32 |
| 4,496,058 | 1/1985 | Harris et al. | 248/231.8 X |
| 4,511,047 | 4/1985 | Elinsky | 211/181 X |
| 4,698,936 | 10/1987 | Helfman | 47/68 |

*Primary Examiner*—Blair M. Johnson

[57] ABSTRACT

This invention serves to adapt an existing bathroom tub-shower enclosure-door headerbar member into a highly effective showering convenience rack, thereby providing a place at which the standing bather may safely and securely store their various soap, shampoo, brush, and related accouterments. The basic embodiment is that of a tray like formation of substantially rectangular configuration, including a special universal bifurcated mounting-bracket located substantially perpendicularly beneath the tray, and preferably as two such brackets arranged inline at substantially opposite ends of the tray undersurface, so as to facilitate a simple stable attachement. The mounting-bracket bifurcations preferably featuring an inwardly projecting splay arrangement converging at their lower distal ends, so as to provide a seucre self-tensioning variable-width clamping action along the opposite inner and outer vertical walls of most any existing headerbar member; thereby obviating need for more complex sorts of fastening means. Hence, a low-cost assembly is set forth which is readily installable by anyone without handyman skills or handtools of any sort; which can be constructed in a variety of materials and methods according to facilities at hand.

4 Claims, 1 Drawing Sheet

FIG.-1
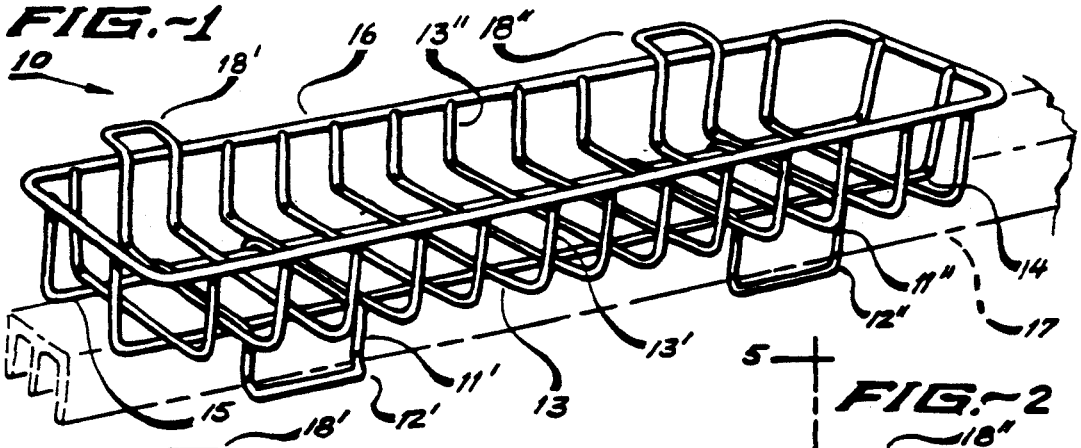
FIG.-2
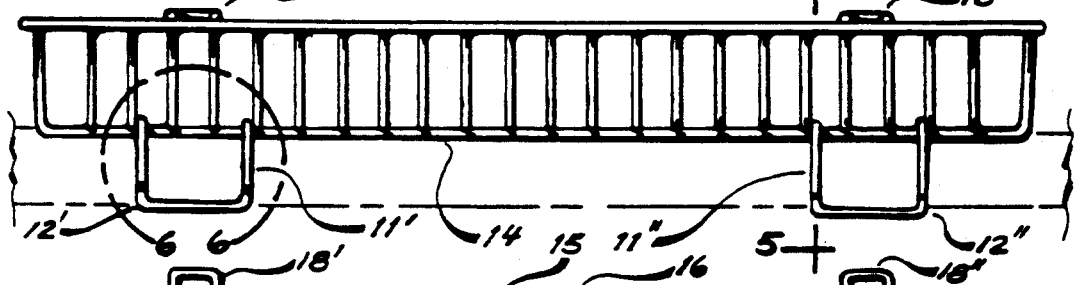
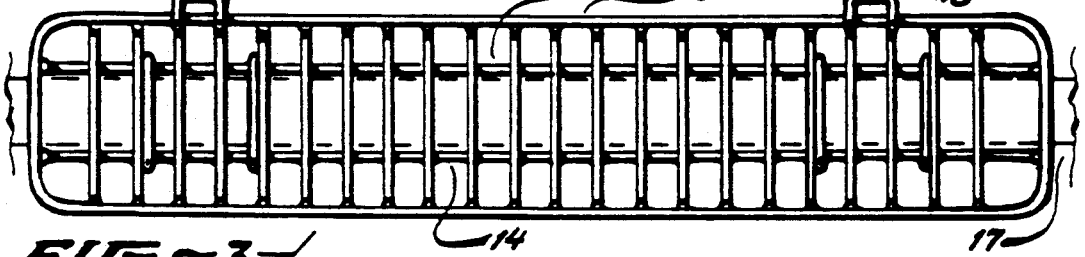
FIG.-3
FIG.-4
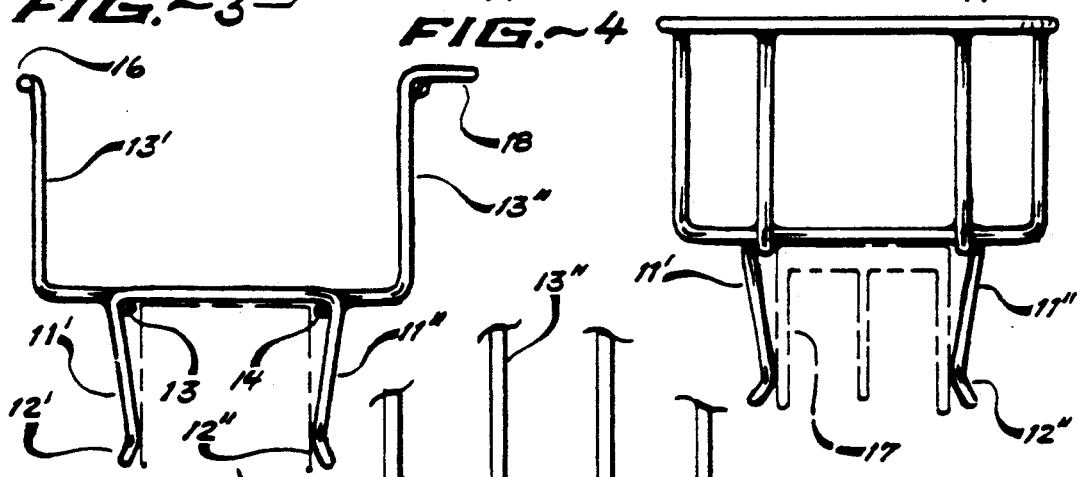
FIG.-5
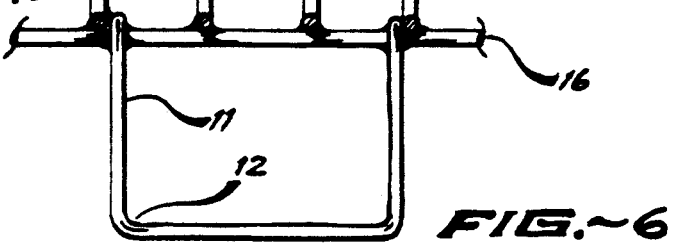
FIG.-6

TUB-SHOWER HEADER-BAR ACCESSORY-RACK W/UNIVERSAL-BRACKET

BACKGROUND OF THE INVENTION

This invention relates to bathroom convenience accessory utility-rack apparatus of various sorts, and in particular to shallow tray-like configuration with self-adjusting mounting-bracket provision, suitable for substantially rust-resistant service in a frequently high-humidity environment.

Heretofore, there was at least one known invention (U.S. Pat. No. 4,698,936/filed October 1987) devised as an elongated leak-proof "planter-bowl" to be installed atop a room-partition, including a relatively complex arrangement of screw-stud(with securing wing-nut fastner) attachable/detatchable cooperating lateral-support L-brackets which are made so as to provide two laterally opposed and slidably-adjustable legs at each end of the bowl assembly, thereby being capable of straddling various widths of partition-walls anywhere from 2-inches to 4¾-inches in width, thereby essentially resulting in a balanced centering effect of the planter-bowl upon the partition top.

Another U.S. Pat. No. Des. 288,998/filed February 1984) shows what is referred to as a "combined shower-door shelf and planter", which sets forth an elongated bracket which merely rests in balance upon the top of the existing tubshower headerbar member; and features a series of equally spaced holes, which serve to receive a plurality of conventional small individual flower-pots.

Finally, another U.S. Pat. No. 4,492,499/filed August 1983) teaches a type of mounting-framework serving as a fixture in support of goods within a transport-vehicle, the only relevant feature here being an arrangement of bifurcated-flanges serving to locate the mounting-pad surfaces securely against the wall-ribs of the vehicle.

Therefore, the inventor hereof believes he has devised a substantially new and useful improvement over the previously described relevant art patents, and so has set about to produce this new product under the tentative tradename HandiCaddi-Mfg./Mkt.Company of SanDiego, Calif.; which shall now be set forth in pertinent detail.

SUMMARY OF THE INVENTION

A. In view of the foregoing discussion about the relevant earlier invention art, it is therefore important to make it clear to others interested in the art that the object of this invention is to provide an inexpensive universally adaptable bathroom tubshower sliding-door headerbar accessory utility-rack which is rather tray like in its preferred elongated configuration. The purpose of the accessory-rack hereof being to provide a truly convenient place at which the standing bather's accouterments such as soap, shampoo, sponge, brush and comb may be located close at hand.

B. Another object of this invention is to set forth a preferably elongated tray like container portion provided with some manner of water drainage from within its confines. Thus, a formed-wire type of fabricated and welded assemblage which has been dipped into a protective vinyl-coating is considered an ideally suitable method of construction, since its natural open appearance provides the ultimate in water drainage effect. Naturally, if the tray portion were constructed as a solid one-piece plastic walled and bottom structure, then suitable drain-holes would need to be included therein.

C. Another object of this invention is to set forth an article according to the above items-A/B wherein a special integrally formed bifurcated vertical-flange like mounting-bracket is included. The feature of this flange mounting member resides in the uniquely converging arrangment of its opposed inwardly projecting splay-leg manner of construction, which being thereby closer at their respective distal ends, affords a more secure self-tensioning variable-width clamping action as applied along the opposite sides of the inner and outer vertical walls of most any existing headerbar member; —thereby obviating need for more complex sorts of fastening means.

D. Another object of this invention is to set forth a tubshower headerbar accessory-rack device which is made of a one-piece construction which is readily installable by anyone without handyman skills or hand-tools of any sort.

DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuring description of these embodiments. Wherein indicia of reference are shown to match related points given in the text, as well as the claims section annexed hereto; and accordingly, a better understanding of the invention and the variant uses is intended, by reference to the drawings, which are considered as primarily exemplary and not to be construed as restrictive in nature; therefore:

FIG. 1 is an upper frontal perspective pictorial view of the overall invention, appearing installed upon a typical existing bathtub headerbar structure indicated via phantom outline.

FIG. 2 is a side-elevation view thereof.

FIG. 3 is an upper plan-view thereof.

FIG. 4 is a 2×-enlarged frontal-elevation view thereof, the rear view being substantially the same is therefore not shown here.

FIG. 5 is a detail view referenced 5:5 in FIG. 2.

FIG. 6 is a 2×-enlarged cross-sectional side-view taken along plane 6:6 in FIG. 2, showing the formation of a universal bracket member formed therewith.

ITEMIZED NOMENCLATURE REFERENCES

10—the overall invention
11'/11"—bifurcated mounting legs
12'/12"—turnout of leg tips
13/13'/13"—tray bottom, +R&L sides
14—outer longitudinal wire element
15—inner longitudinal wire element
16—tray rim portion
17—existing tub-headerbar (not part of invention)
18'/18"—hanger-ring members

DETAILED DESCRIPTION OF THE PREFERRED EMBODIMENTS

Initial reference is given by way of FIG. 1, wherein is exhibited a preferred version 10 of the overall generic invention, which in this example is fabricated via the well known production method of a wire-feed forming machine, often substantially computerized via pre-programmed tape so as to bend and resistance-weldup 3-dimensional products of consistantly uniform quality. The completely fabricated product may then be dipped into a vat containing a protective material such as molten vinyl-plastic, which after lifted out dries on the product to a thick attractive colorful anti-rust coating layer. Other important points of the invention are the lower bifurcated clip-bracket like mounting-legs 11'/11" arranged near the extreme ends of the tray like accessory-rack portion, the plurality of laterally arranged wire elements which make up the tray bottom 13 and side walls 13'/13", plus a couple of longitudinally arranged wire pieces 14 and 15 which comprise reinforcement to the bottom wire array while similarly forming the end wall portions 14'/15' and 14"/15"; all of which said wire elements are resistance-welded, both at their respective points of intersection and upwardly upon the tray-rim portion 16 as well. Note here also, how the said elements 14 and 15 lay parallel allong side of the pre-existing bathroom tubshower headerbar member 17 shown in phantom outline for reference purposes only.

Reference to FIGS. 2 and 3 further reveals how the invention assembly is preferably positioned atop the headerbar 17, and study of enlarged FIGS. 4 and 5 reveals additionally how the bifurcated mounting legs 11'/11" are effectively formed with a slight downwardly converging compliance-splay, thereby facilitating a unique self-clamping action capable of automatically adjusting to the various brand widths of headerbars known to exist on the market. Note also, how the distal ends of the legs 11'/11" include a slight toe turnout tip portions 12'/12" serving to ease the manual press-on installation proceedure.

While the detail features of FIGS. 4/5/6 serve to disclosed how the invention is preferably fabricated from bent-wire, by welding the elements at all intersecting places; it is also desirable that an alternate versions be made available subatantially according to the claims of this invention. One other version may feature a substantially solid perimeter wall and preferably intergral bottom portion thereto, whereby the said bifurcated-legs will exhibit the same self-clamping arrangement, yet will possibly be injection-molded as a solid downward extending entity, rather than as the U-shaped affair represented here. Another convenience feature of this tubshower bathing accessory is the optional provision of one or more abreviated loop like hanger-ring members 18'/18", which serve to readily receive a conventional toothbrush or safety-razor implements(either handle down) at the ready.

Accordingly, it is understood that the utility of the foregoing adaptations of this invention are not dependent upon any prevailing invention patent necessarily; and while the present invention has been well described hereinbefore by way of preferred embodiments, it is to be realized that various changes, alterations, rearrangements, and obvious modifications may be resorted to by those skilled in the art to which it relates, without substantially departing from the implied spirit and scope of the instant invention. Therefore, the invention has been disclosed herein by way of example, and hence not by thus imposed limitation.

What is claimed of proprietary inventive origin is:

1. A universally adaptable convenience accessory rack for mounting atop an existing headerbar fixture, comprising: a substantially rigid wire tray having a substantially vertical perimeter side wall integral with and surrounding a horizontal bottom portion; including at least one fixed bifurcated wire leg like mounting bracket formed thereunder in a downwardly projecting manner, each said bifurcated leg like mounting bracket comprising a horizontal base and legs extending angularly downward therefrom, said base comprising U-shaped elements having sides and a bight portion, said sides being integral at the top thereof with respective ends of said base members, said bracket having manually bendable adjustability means, which when adjusted to a spaced gap interval slightly smaller than the width of the headerbar, is capable of imposing a substantial opposed clamping action for stable retention atop said existing supporting headerbar.

2. A headerbar accessory rack according to claim 1, wherein said tray includes at least two opposed said bifurcated mounting brackets arranged relative to one another in a spaced manner; thereby lending added stability to the said tray.

3. A headerbar accessory rack according to claim 1, whereby said tray has a protective plastic resin coating such as poly-vinyl-cloride, so as to resist corrosion and provide beautification.

4. A headerbar accessory rack according to claim 1, wherein said tray includes at least one side cantilevered convenience loop hanger member extending from said side wall perimeter; thereby serving to receive additional accouterments at the ready, such as a toothbrush or safety-razor.

* * * * *